United States Patent [19]

Dorn

[11] 4,260,214

[45] Apr. 7, 1981

[54] FAULT-CLOSABLE ELECTRICAL CONNECTOR

[75] Inventor: Michael M. Dorn, Florissant, Mo.

[73] Assignee: International Telephone and Telegraph Corporation, New York, N.Y.

[21] Appl. No.: 59,946

[22] Filed: Jul. 23, 1979

[51] Int. Cl.[3] ..... H01R 13/52

[52] U.S. Cl. ..... 339/111

[58] Field of Search ..... 339/111, 91 R, 94 C, 339/143 R; 200/144 C, 149 A

[56] References Cited

U.S. PATENT DOCUMENTS

| | | | |
|---|---|---|---|
| 3,474,386 | 10/1969 | Link | 339/111 X |
| 3,958,855 | 5/1976 | Oakes | 339/111 |
| 4,088,383 | 5/1978 | Fischer et al. | 339/111 |
| 4,170,394 | 10/1979 | Conway | 339/111 |

*Primary Examiner*—Neil Abrams

*Attorney, Agent, or Firm*—James B. Raden; William J. Michals

[57] ABSTRACT

A bushing plug for power distribution systems and of the type having a stationary female contact for receiving and making electrical connection with the arc-follower terminated male electrode of an associated elbow connector. The bushing plug includes an elastomeric housing which receives a tubular metallic insert body therein. The inner end of the insert body is connected to an external terminal by way of a threaded fastener. A female contact is press-fitted into the lower end of the insert body and a tubular arc-snuffer member is slidably mounted within the insert body for movement toward and away from the female contact. The arc-snuffer includes a pair of movable contacts respectively mounted within a pair of radially opposed slots in the inner end portion thereof. A camming ring is mounted within an annular groove provided along the inner surface of the insert body and between the female contact and the male electrode receiving opening of the housing. When closing under fault conditions, a contact prestrike arc occurs between the advancing male electrode and the female contact. The resulting gas pressure rapidly translates the arc-snuffer outwardly until the moving contacts cammingly and wedgingly engage both the camming ring and the male electrode to extinguish the arc.

13 Claims, 12 Drawing Figures

FAULT-CLOSABLE ELECTRICAL CONNECTOR

BACKGROUND OF THE INVENTION

This invention relates to current responsive, gas-actuated electrical connectors of the type embodied in a bushing plug for use in power distribution systems.

Electrical connectors of the type utilizing arc-responsive material for evolving arc-quenching gas in response to an arc being struck between movable electrodes and wherein the gas pressure is utilized to extinguish the arc are known and have been widely used in the art. These connectors are generally divided into three types the first of which is exemplified by U.S. Pat. No. 3,474,386 which utilizes a moving female contact constrained for movement within a piston assembly and wherein current is transferred to the fixed electrode of the bushing plug by means of a flexible copper cable. The piston or moving female contact assembly moves during normal switching operations, and during a fault closure the female contact is propelled by gas pressure to move into engaging connection with the advancing male electrode of the elbow connector. The second type of current responsive, gas-actuated electrical connector is exemplified in U.S. Pat. No. 3,958,855. This type of connector utilizes an auxiliary contact which moves in response to gas pressure developed during a fault closure operation and functions to transfer the arc struck between the male electrode and the stationary female contact to a remote point of the bushing plug which is removed from the arc-responsive material of the bushing plug. The third type of bushing plug is exemplified in U.S. Pat. No. 4,088,383, which is assigned to the same assignee as the present invention, wherein the female contact is carried by a moving assembly which transfers current to the fixed electrode of the bushing plug by means of a sliding contact.

These prior art bushing plugs suffer from one or more disadvantages such as the cost of making a reliable sliding or flexible connection for the current levels which must be handled during normal switching operations and/or fault-closure operations. The metal piston assemblies of these devices are also expensive and the large diameters of the piston assemblies require an undesired dimensional reduction of the surrounding bushing insulation and therefore a corresponding reduction in electrical performance. Further, the auxiliary contact or arcing ring device does not establish positive contact with the male electrode of the elbow connector which, therefore, decreases its fault-closure performance and specifications.

These and other disadvantages are overcome by the present invention wherein there is provided a bushing plug including a moving assembly which is lighter and therefore has a lower inertia providing faster response which also reduces arcing time. In a normal operation, and in its fully closed position, the bushing plug of the present invention provides a direct path for current which is not required to pass through sliding contacts or flexible cables. Further, improved electrical stress relief is accomplished as a result of the relatively small diameter of the metallic insert body which is provided coaxially with the surrounding elastomeric housing.

SUMMARY OF THE INVENTION

Briefly, a bushing plug having a female contact for receiving and making engaging connection with the male electrode of an associated connector is provided.

The bushing plug includes an elastomeric housing having a generally tubular configuration about an axis thereof and a generally tubular conductive insert body is fixedly and coaxially mounted within the housing. The insert body forms a chamber therein which is closed at the inner end thereof and includes means at its inner end for receiving an external terminal in electrically conductive relationship therewith. A generally tubular female contact is fixedly mounted within and conductively engages the conductive insert toward the inner end thereof. A tubular insulating member of arc-responsive material is slidably and coaxially mounted within the tubular conductive insert for movement toward and away from the female contact and for coaxially surrounding the male electrode in close-spaced relationship therewith. A movable contact is carried by the insulating member for movement therewith from a first position toward the female contact to a second position away from the female contact and wherein the movable contact engages both the male electrode and the insert body to provide a direct path for current between the male electrode and the insert body when the movable contact is moved into the second position.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
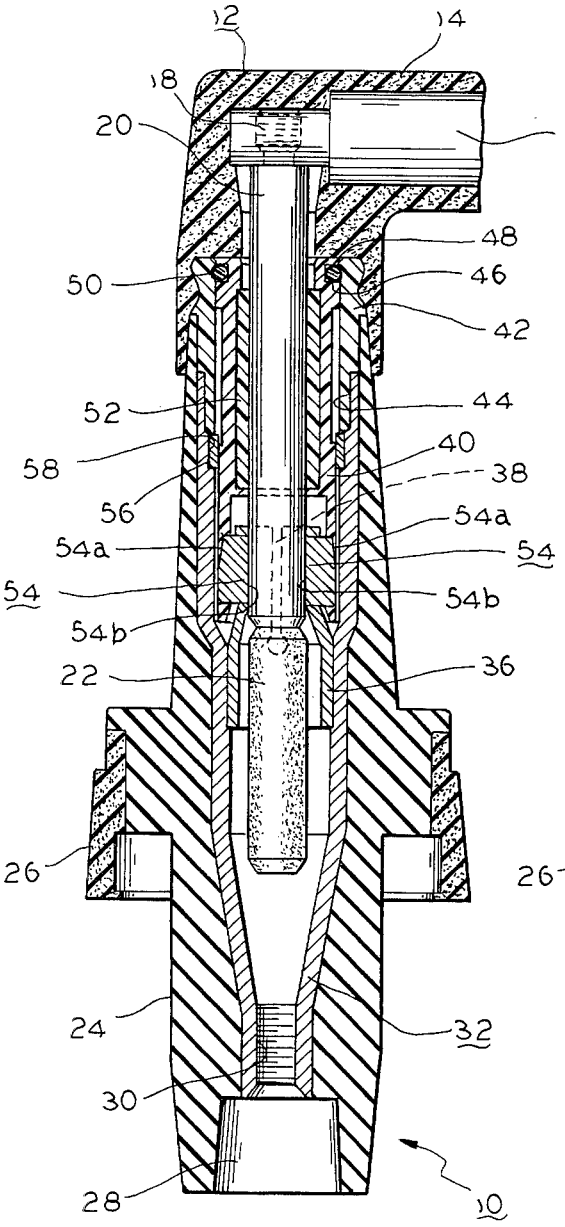
FIG. 1 is a side elevation, cross-sectional view of an electrical connector in accordance with the principles of the present invention, shown in its normal closed position.
Figure 2:
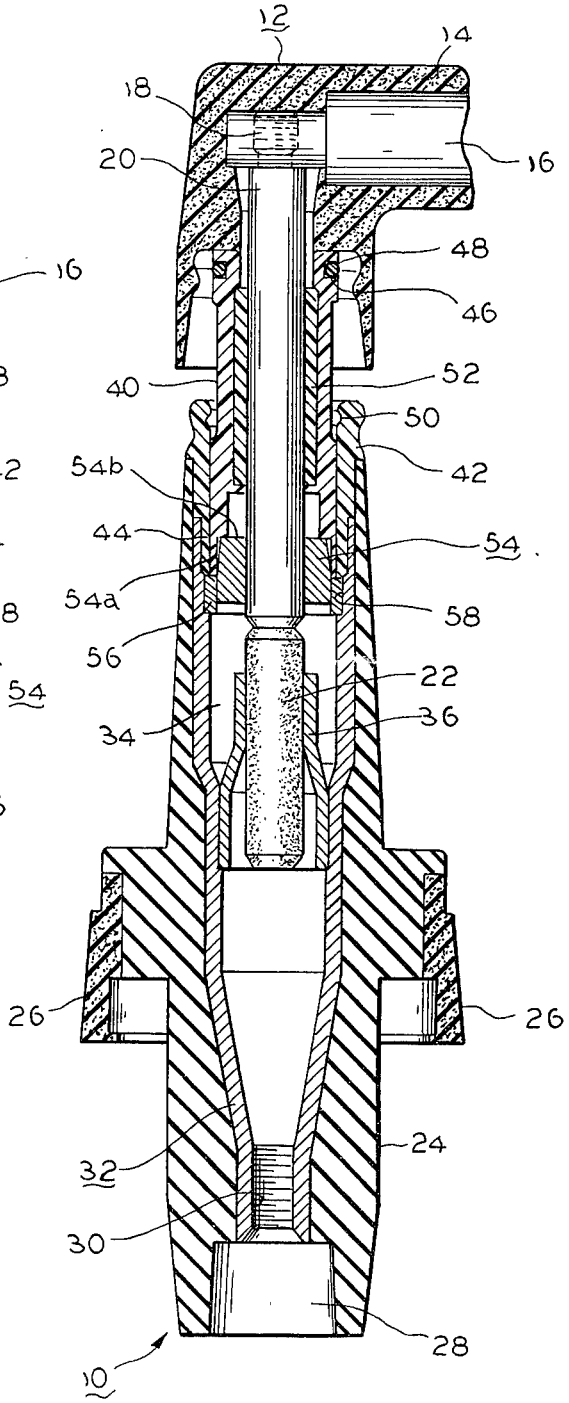
FIG. 2 is a similar sectional view of the connector of FIG. 1 which further illustrates the relative position of the component members relative to an associated male electrode of an elbow connector which would result from a fault closure.

Referring now to FIGS. 1 and 2, there are shown cross-sectional views of a bushing plug, shown generally at 10, in accordance with the teachings of the present invention and illustrated in conjunction with a partial view of the central portion of an associated elbow connector 12. The portions of the elbow connector illustrated in FIGS. 1 and 2 are essentially cut-away portions illustrating so much of an elbow connector as is necessary for a better understanding of the present invention. Elbow connector 12, as illustrated in FIGS. 1 and 2, includes a central semi-conductive insert portion 14 which receives a cable lug 16 therein. Lug 16 is provided with a threaded bore 18 for receiving the threaded end of a male electrode 20. Male electrode 20 is terminated at its end portion with an arc-follower member 22 comprising an arc-responsive material which generates arc-extinguishing gases in the presence of an electrical arc struck between the electrodes of the connection, as is well known in the art.

Bushing plug 10, in accordance with the present invention, includes a conventional elastomeric housing 24 having a layer of semi-conductive elastomeric material 26 about an outer circumference thereof and which receives the projecting threaded fastener (not shown) of an associated bushing well (not shown) through a lower opening 28 thereof. In this manner, the bushing plug is mounted to a transformer, a switching panel or any other interfacing apparatus. The projected threaded fastener of the associated bushing well engages a threaded portion 30 of a generally tubular metallic insert body 32 which is fixedly mounted within housing 24, as by being molded therein. The central portion of insert body 32 forms a chamber 34 which is closed at the lower end of insert body 32 by the external projecting fastener. Insert body 32 thus provides an enclosed chamber which opens at the outer or male electrode receiving opening of bushing plug 10. A female contact 36 is coaxially mounted within the lower central portion of insert body 32, as by being press-fitted therein. Female contact 36 includes a plurality of circumferentially spaced and longitudinally extending slots 38, only one of which is illustrated in FIG. 1. Slots 38 are located at the outer end portion of female contact 36 and define radially inwardly biased fingers forming a contact receiving surface which cooperates with male electrode 20 of the associated elbow connector during normal switching operations to provide a current path directly therebetween.

Bushing plug 10 further includes an arc-snuffer member 40 coaxially and slidably mounted within the upper portion of insert body 32 for movement toward and away from the fixedly mounted female contact 36. The upper end of bushing plug 10 is terminated or closed by a generally tubular snuffer tip member 42 the lower end of which threadedly engages a threaded portion 44 of the upper end of insert body 32. The upper end of arc-snuffer 40 includes a annular shaped recess 46 for receiving an "O"-ring 48 therein which cooperates with a recessed groove or undercut portion 50 of snuffer tip 42. This arrangement functions to releasably "lock" arc-snuffer 40, in the position illustrated in FIG. 1, during normal switching operations. Arc-snuffer 40 preferably comprises a two-piece assembly wherein a tubular snuffer member 52 which comprises an arc-responsive material having enhanced gas-evolving characteristics is coaxially disposed within arc-snuffer 40. That is, the gas-evolving characteristics of insert member 52 are superior to the gas-evolving characteristics of the surrounding portion of arc-snuffer 40. The outer portion of arc-snuffer 40 also preferably comprises an arc-responsive material but is primarily selected for strength.

Thus, the combination provides mechanical strength and superior gas-evolving characteristics.

The inner end of arc-snuffer 40 includes a pair of radially opposed moving contact members 54 which are carried by arc-snuffer 40 in a pair of corresponding slots provided in the inner end portion of arc-snuffer 40. It can be seen that the upper portions of moving contact members 54 are provided with tapered or cam surfaces which taper radially inwardly toward the outer direction. Moving contact members 54 include radially inward projections **54*b* which extend through the slots provided in arc-snuffer 40 and partially into the respective ones of slots 38 of female contact 36. The upper portion of insert body 32 includes a metallic camming ring 56 which is received within a annular recess or groove 58 of insert body 32** and in conductive relationship therewith.

Referring now to the operation of the bushing plug 10 of FIGS. 1 and 2 and in accordance with the principles of the present invention, FIG. 1 illustrates the normal-operation, fully closed position of bushing plug 10 in conjunction with elbow connector 12. It can be seen that the male electrode 20 of elbow 12 is in direct contact with the fixedly mounted female contact 36 of bushing plug 10. Thus, the current path between the elbow connector and bushing plug 10 is directly between male electrode 20, through female contact 36 and to insert body 32.

Referring now to FIG. 2, there is shown an illustration of the relative positions of the elbow connector 12 and bushing plug 10 and, more particularly, arc-snuffer 40 as would result during a fault closing operation. That is, as the advancing male electrode 20 approaches female contact 36 (with arc-snuffer 40 and therefore the moving contacts 54 initially being in the position illustrated in FIG. 1) a point of arc initiation is reached wherein a contact prestrike arc occurs between the inner end of male electrode 20 and the upper end portion of female contact 36. The arc then causes an evolution of gas which is generated by the arc-responsive material 22 and the tubular insert 52 which gas is channeled downwardly through insert body 32 and into chamber 34. The resulting pressure acts on the lower surface of arc-snuffer 40 and in a differential manner so as to rapidly translate arc-snuffer 40 upwardly until moving contact members 54 cammingly and wedgingly engage camming ring 56. Camming ring 56 therefore urges moving contact members 54 into camming and wedging engagement with the adjacent lower metallic portion of male electrode 20.

It has been found that in response to a fault closure, and when arc-snuffer 40 is thereby translated into the position shown in FIG. 2, that the moving contact members 54 are translated into engagement with camming ring 56 and the outer cylindrical surface of male electrode 20 with such force so as to provide a rigid jam fit. When this occurs, the arc is rapidly and efficiently extinguished. It will thus be appreciated by those skilled in the art, that in response to a fault closure a positive direct current path is thus provided between male electrode 20 and insert body 32 the latter of which is fixedly mounted to and in direct electrical engagement with the external terminal which threadedly engages threaded bore 30 of insert body 32.

Figure 3B:
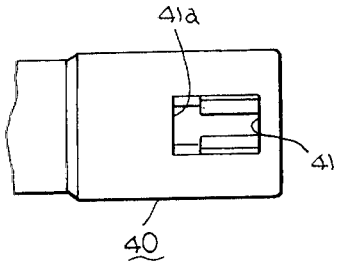
FIGS. 3A–3D and 4A–4D are various views illustrating in somewhat greater detail of the various component parts of the bushing plug illustrated in FIGS. 1 and 2; and, FIGS. 5 and 6 are side elevation, cross-sectional views of an alternate embodiment of the fault-closable electrical connector in accordance with the principles of the present invention.
Figure 3C:
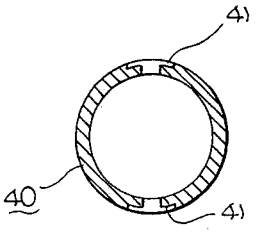
Figure 3A:
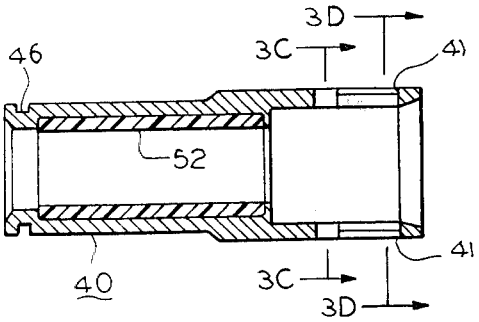
Figure 3D:
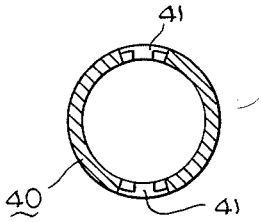
Figure 4A:
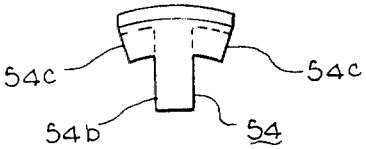
Figure 4C:
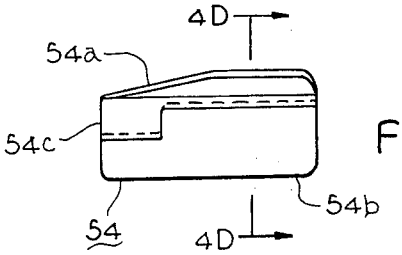
Figure 4B:
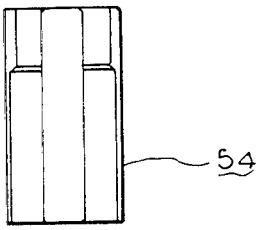
Figure 4D:
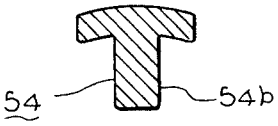

Referring now to FIGS. **3*a*–3*d* there are shown various views of arc-snuffer 40 of FIGS. 1 and 2. FIG. 3*a* provides a cross-sectional view of arc-snuffer 40 illustrating somewhat more clearly slots 41 which are provided therein at the lower end thereof for receiving moving contacts 54 therein. Referring to FIGS. 4*a*–4*d* there are shown various views of the cross-sectionally generally T-shaped moving contact members 54 which are received within the slots 41 of arc-snuffer 40. Slots 41 are also T-shaped (in the radial direction) and moving contacts 54 further include lateral projections 54*c* which are respectively received within the corresponding cross bars 41*a* of the generally T-shaped slots 41. As previously described, the radially inwardly directed projections 54*b* of moving contacts 54 extend through slots 41 of arc-snuffer 40 and into the longitudinal slots 38 of fixed female contact 36. It should also be appreciated that the maximum radial dimension of moving contacts 54 is greater than the radial distance between the cylindrical surface portion of male electrode 20 and the radial inner surface of camming ring 56 of FIGS. 1 and 2**. This structural relationship therefore further enhances the camming and wedging engagement described above.

Figure 5:
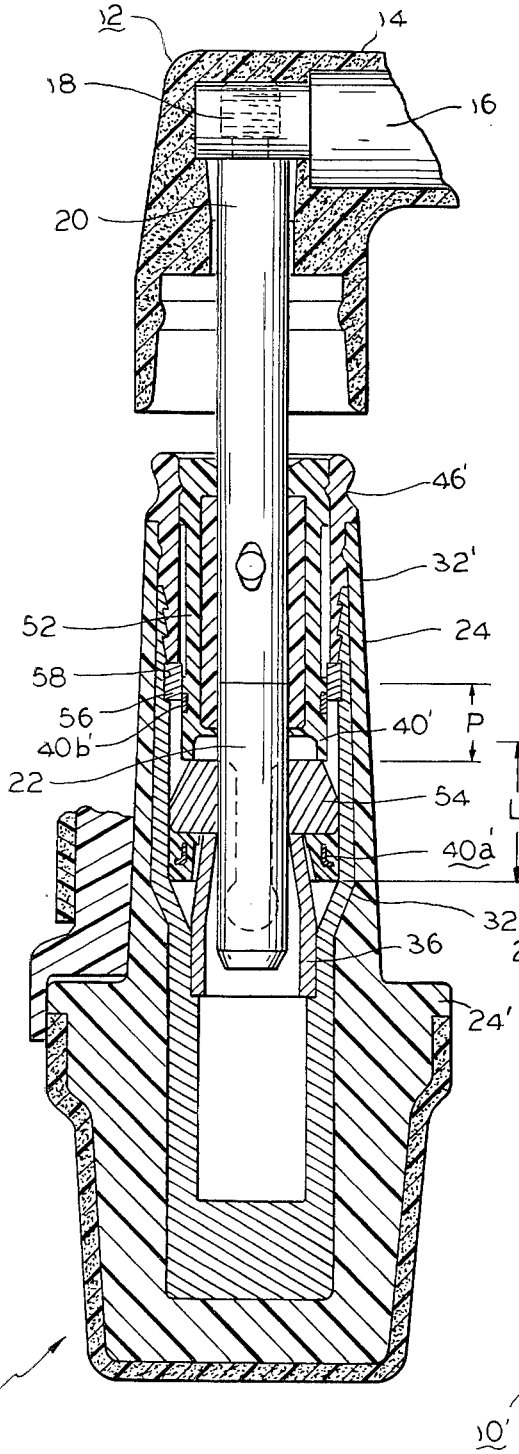
Figure 6:
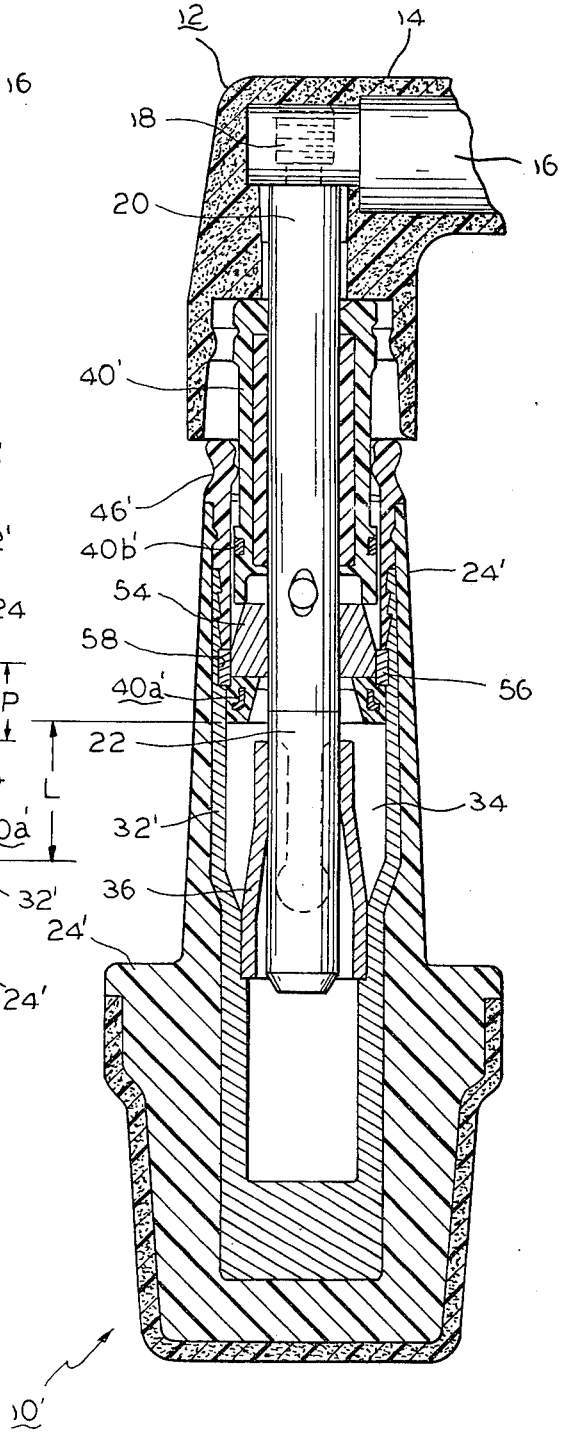

Referring now to FIGS. 5 and 6 there are shown side elevational, cross-sectional views of an alternate embodiment of the bushing plug in accordance with the present invention. FIGS. 5 and 6 are similar to FIGS. 1 and 2 and accordingly like elements bear like reference numerals. Bushing plug 10' is illustrated as it would appear on a bus bar configuration rather than a bushing well interface as illustrated in FIGS. 1 and 2. The lower end of insert body 32' of bushing plug 10' therefore includes means for electrically coupling bushing plug 10' to the adjacent bushing plug or plugs. Bushing plug 10' of FIGS. 5 and 6 essentially differs from that of FIGS. 1 and 2 in that a "barbed" snap-fit arrangement is provided between snuffer tip member 46' and insert body 32' as opposed to the threaded engagement depicted in FIGS. 1 and 2. It can be seen that the mating surfaces of snuffer tip member 46' and insert body 32' are provided with complementary, nesting inclined surfaces which provide a push-in, snap-fit assembly of the snuffer tip member with the insert body. The lower end of arc-snuffer 40' of FIGS. 5 and 6 is provided with a slotted metallic reinforcing sleeve **40*a'* which is molded therein. The upper portion of sleeve 40*a'* includes an annular portion 40*b'* which extends radially outwardly to the cylindrical surface of arc-snuffer 40'. Sleeve 40*a'* includes a pair of radially opposed slots which permit moving contacts 54 to extend therethrough, and sleeve 40*a'* functions to mechanically reinforce and strengthen the lower portion of arc-snuffer 40'. The reinforced lower end portion of arc-snuffer 40' projects radially outwardly to provide an additional stop member which engages camming ring 56. FIGS. 5 and 6 further illustrate the length of travel, L, of arc-snuffer 40' with respect to the typical length, P, of a prestrike arc which is initially struck between the advancing male electrode 20 and the upper end portion of female contact 36**. It can be seen that the travel L of the arc-snuffer is preferably significantly greater than the prestrike distance P. This structural relationship ensures an overlapping engagement of the moving contacts with the male electrode.

In still other constructed embodiments, the moving arc-snuffer member has taken different forms and configurations. For example, the lower portion of the member can be provided as a tubular metallic sleeve which threadedly engages an insulating/arc-responsive material upper portion of the arc-snuffer member, and wherein the metallic sleeve includes radially extending moving contact members integrally formed therewith. In this embodiment the walls of the metallic sleeve in the vicinity of the moving contacts, tend to deform radially inwardly as the integral moving contacts engage the camming ring. Finally, in other constructed embodiments, the cross-sectional area of the moving contacts has been varied so as to increase the contact area of the male electrode engaging portions thereof. Thus, it will be appreciated by those skilled in the art that various modifications and alterations may be indulged in order to meet the needs of a given application of the device in accordance with the principles and teachings of the present invention.

What has been taught, then, is an arc-responsive, gas-actuated, fault-closable bushing plug facilitating, notably, a bushing plug in which the moving member is lighter in weight and in which the metallic insert body is smaller in diameter than bushing plugs of the prior art. In normal operation, a current path is provided directly between the movable male electrode and the fixed female contact without necessitating sliding contacts or flexible cables. Further, the smaller diameter of the insert body and therefore increased radial dimension of the surrounding elastomeric housing provides improved electrical stress relief. The forms of the inventions illustrated and described herein are but preferred embodiments of these teachings in the forms currently preferred for manufacture. They are shown as illustrations of the inventive concepts, however, rather than by way of limitations and it is pointed out that various modifications and alterations may be indulged in within the scope of the appended claims.

What is claimed is:

1. A bushing plug having a female contact for receiving and making engaging connection with the male electrode of an associated connector, said bushing plug comprising, in combination:

an elastomeric housing having a generally tubular configuration about an axis thereof;

a generally tubular conductive insert body fixedly and coaxially mounted within said housing, said insert body forming a chamber therein which is closed at the inner end thereof and having means at said inner end for receiving an external terminal in electrically conductive relationship therewith;

a generally tubular female contact fixedly mounted within and conductively engaging said conductive insert toward the inner end thereof;

a tubular insulating member of arc-responsive material for evolving arc-quenching gas in response to an arc being struck between said male electrode and said female contact and being slidably and coaxially mounted within said tubular conductive insert for movement toward and away from said female contact and for coaxially surrounding said male electrode in close-spaced relationship therewith; and, a movable contact carried by said insulating member for movement therewith from a first position toward said female contact to a second position away from said female contact and wherein said movable contact engages both said male electrode and said insert body to provide a direct path for current between said male electrode and said insert body when said movable contact is moved into said second position.

2. The bushing plug according to claim 1, wherein said insert body includes a radially inwardly directed contact member fixedly mounted therein for engaging said movable contact and urging said movable contact radially inwardly into engagement with said male electrode when said movable contact is moved into said second position.

3. The bushing plug according to claim 2, wherein said movable contact is tapered radially inwardly in the direction of movement toward said second position wherein said movable contact cammingly engages said contact member as said movable contact is translated toward said second position.

4. The bushing plug according to claim 3, wherein said movable contact comprises a plurality of contacts circumferentially spaced about the inner end portion of said tubular insulating member and wherein said contact member comprises a camming ring mounted in an annular groove extending radially outwardly from the radially inner surface of said insert body.

5. The bushing plug according to claim 4, wherein each of said plurality of contacts includes a radially inwardly directed projection which is received within and extends through a corresponding one of a plurality of slots provided in the inner end portion of said insulating member for wedgingly engaging said male electrode.

6. The bushing plug according to claim 5, wherein said female contact includes a plurality of circumferentially spaced and longitudinally extending slots extending therethrough and wherein said projection extend through and terminate at the radially inner surface of said female contact slots.

7. The bushing plug according to claim 6, wherein the outer ends of said movable contacts extend no further then the outer end of said female contact when said tubular insulating member is moved into said first position.

8. The bushing plug according to claim 1, wherein travel distance of said tubular insulating member exceeds the prestrike length of the arc struck between said male electrode and said female contact.

9. The bushing plug according to claim 1, wherein the radial distance between said insert body and the radially outer surface of said male electrode at the point where said movable contact engages said male electrode and said insert body when said tubular member is moved into said second position is less than the maximum radial dimension of the engaging portion of said movable contact wherein said movable contact wedgingly engages said male electrode and said insert body when said tubular member is moved into said second position.

10. The bushing plug according to claim 2, wherein the radial distance between said contact member and the radially outer surface of said male electrode at the point where said movable contact engages said male electrode and said contact member when said tubular member is moved into said second position is less than the maximum radial dimension of the engaging portion of said movable contact wherein said movable contact wedgingly engages said male electrode and said contact member when said tubular member is moved into said second position.

11. A bushing plug having a female contact for receiving and making engaging connection with the male electrode of an associated connector, said bushing plug comprising, in combination:

an elastomeric housing having a generally tubular configuration about an axis thereof;

a generally tubular conductive insert body fixedly and coaxially mounted within said housing, said insert body forming a chamber therein which is closed at the inner end thereof and having means at said inner end for coupling to an external terminal in electrically conductive relationship therewith;

a generally tubular female contact fixedly mounted within and conductively engaging said conductive insert toward the inner end thereof;

a generally tubular member slidably and coaxially mounted within said tubular conductive insert for movement toward and away from said female contact and for coaxially surrounding said male electrode in close-spaced relationship therewith, at least a portion of said tubular member comprising an arc-responsive material for evolving arc-quenching gas in response to an arc being struck between said male electrode and said female contact; and, said tubular member including a movable contact for movement therewith from a first position near said female contact to a second position away from said female contact and wherein said movable contact engages both said male electrode and said insert body to provide a direct path for current between said male electrode and said insert body when said movable contact is moved into said second position.

12. The bushing plug according to claim 11, wherein the travel distance of said movable contact between said first and second positions exceeds the prestrike length of the arc struck between said male electrode and said female contact.

13. The bushing plug according to claim 12, wherein said insert body includes a radially inwardly directed contact member fixedly mounted therein for engaging said movable contact and urging said movable contact radially inwardly into engagement with said male electrode.

* * * * *